United States Patent [19]

Wilston

[11] 4,015,750

[45] Apr. 5, 1977

[54] PASTE DISPENSING DEVICE

[76] Inventor: Arthur Lloyd Wilston, 300 Redington Road, Troy, Pa. 16947

[22] Filed: May 4, 1976

[21] Appl. No.: 683,237

Related U.S. Application Data

[63] Continuation-in-part of Ser. No. 566,325, April 9, 1975, Pat. No. 3,974,943.

[52] U.S. Cl. ..... 222/103

[51] Int. Cl.[2] ..... B65D 35/28

[58] Field of Search ..... 222/103, 105

[56] References Cited

UNITED STATES PATENTS

| | | | |
|---|---|---|---|
| 2,766,908 | 10/1956 | Wheeler | 222/103 |
| 2,830,736 | 4/1958 | Schneider | 222/103 |

*Primary Examiner*—Stanley H. Tollberg
*Assistant Examiner*—Hadd Lane
*Attorney, Agent, or Firm*—Cushman, Darby & Cushman

[57] ABSTRACT

A holder and dispenser for material contained in a collapsible tube is disclosed and includes a housing for retaining a collapsible tube in position; the housing is formed with guide shoulders on opposite sides of a slot formed in a wall of the housing; a wedge-shaped press member is disposed within the housing with a portion of the press member in engagement with the guide shoulders; the press member is provided with a handle which includes a stem portion securely fastened to the press member and which extends through the slot and terminates exteriorly of the housing with a manually engageable portion; the manually engageable portion is shaped to have a longitudinal dimension which may be substantially equal to the longitudinal dimension of the press member but which is bent or curved approximately at its midpoint to enable a user to rock the handle about the bent midpoint to thereby pivot through a limited angle the press member into and out of engagement with the collapsible tube positioned in the housing; the handle also permits the sliding of the press member along the length of the housing guided by the slot and the guide shoulders of the housing; the manually engageable portion of the handle also serves to space the bottom of the press member a selected distance from the bottom wall of the housing to permit the collapsed tube to fit between the press member and the bottom wall of the housing.

4 Claims, 6 Drawing Figures

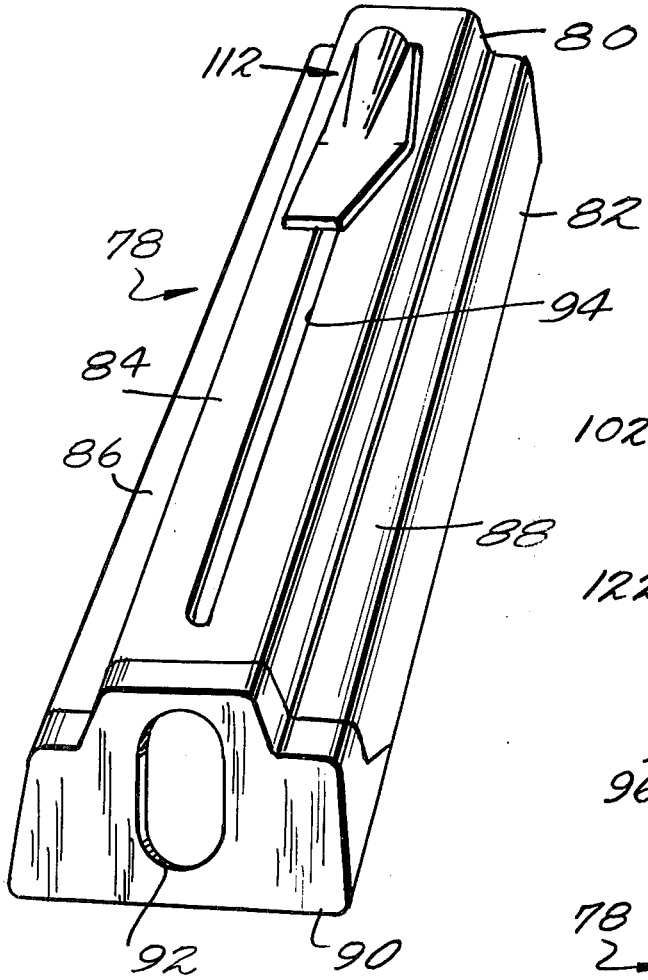
Fig. 5.
Fig. 6.
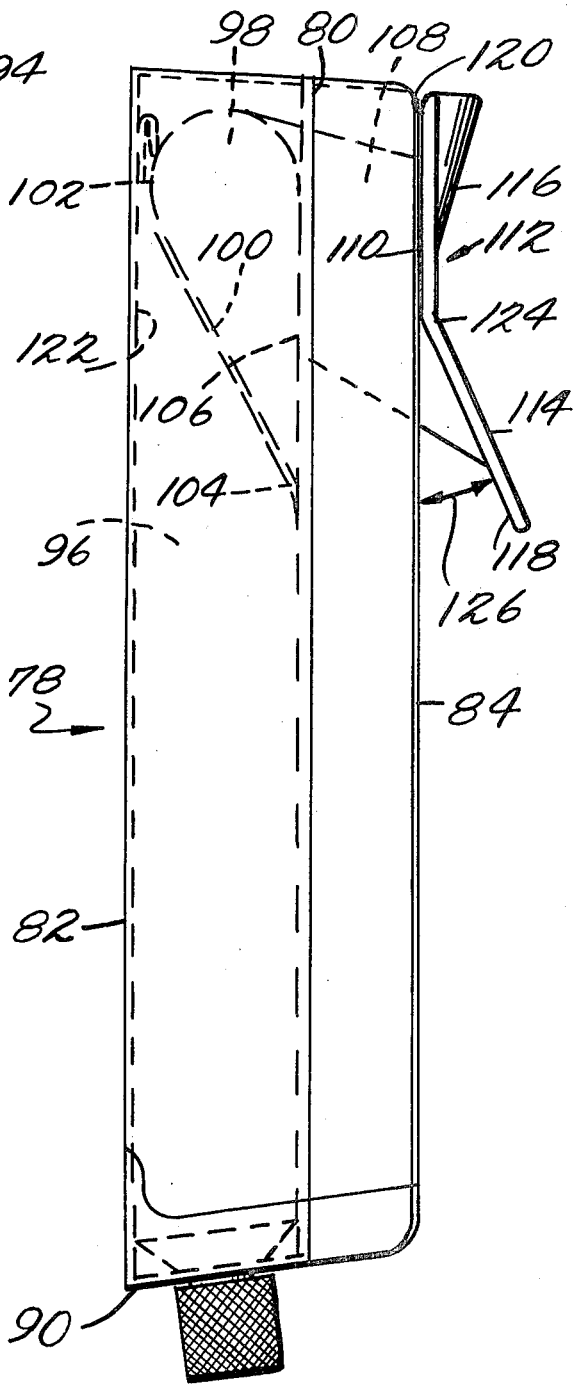

PASTE DISPENSING DEVICE

STATUS OF PRIOR APPLICATIONS

The present application is a continuation-in-part of application, Ser. No. 566,325, filed Apr. 9, 1975, now U.S. Pat. No. 3,974,943 of Aug. 17, 1976.

BACKGROUND AND SUMMARY OF THE INVENTION

The present invention relates to dispensing devices for collapsible, tubular containers, and, more particularly, to an improved manually operated tube press member for such devices.

The manufacturers of dispensing devices for tubular containers have long been confronted with the difficulty of manufacturing a dispenser which will accommodate a large variety of container sizes as well as the problem of providing a dispensing operation that can be easily controlled to dispense a broad range of quantities of material from a collapsible tube. In view of the fact that a large number of commercial products are presently stored in tubular containers for sale and use by the consumer, it has become particularly desirable to provide flexibility in the amount of material that can be dispensed from such devices so that the consumer market for a single type of dispensing device can be broadened to accommodate a wider range of products.

By way of example, presently, not only are dental creams and shaving creams packaged in collapsible tubes, but also, a number of pharmaceutical products, shampoos, and cleansing detergents are now available in such tubular containers. In addition, a number of products of the foregoing types are packaged in a variety of concentrations of ingredients for the purpose of varying their properties. Thus, where members of a single family have purchased a product at a given concentration, individual members of the family will utilize the product in a corresponding variety of quantities for their individual applications. This is particularly important in the use of body cleansing creams and hair dye solutions.

Previously, dispensing devices for tubular containers were primarily concerned with dental cream or toothpaste containers which, therefore, were intended to dispense only small quantities of paste from a fairly standardized size of container. Thus, such dispensing devices, in general, could only be used for toothpaste tubes. As a result, the market for such devices was severely limited.

In the known devices in this field, in order to provide the capability of dispensing material both completely from a collapsible tube in one operation as well as in small increments, complicated tube contacting and manipulating devices have been employed so that the manufacturing expense has been increased, and, correspondingly, the commercial acceptance of such devices has been limited. Also, often, since these types of devices are subject to abuse such as by the children in a family, the tube manipulating mechanisms have been short-lived particularly where rack and gear arrangements or threaded member advancing arrangements have been employed.

Where cleaning of the dispensing device becomes necessary with the prior art devices, it has been difficult to disassemble the element particularly where complicated tube manipulating mechanisms are employed. The cleaning operation can be particularly time consuming and troublesome where a defective tube is installed in the dispensing device and breakage of the tube occurs during the dispensing operation.

In many of the prior art devices, a cylindrical roller or ball has been employed to carry out the tube squeezing operation. Such arrangements have been useful where the material from which the tubular container is constructed is relatively stiff and not subject to resilient reaction when subjected to pressure. However, many types of cosmetic products as well as other commodities are now packaged in containers of relatively flexible or flowable material so that where a roller or ball member is employed, which is movable along a cylindrical housing to effect dispensing, such tubular containers exhibit a tendency to flow around the roller or ball element resulting in jamming of the element in the housing.

Prior art references relating to the field of the present invention are as follows:

| U.S. Patents | Issue Dates |
|---|---|
| 1,311,354 | July 9, 1919 |
| 1,352,425 | September 14, 1920 |
| 1,353,747 | September 21, 1920 |
| 3,326,419 | June 20, 1967 |

The dispensing device of the present invention avoids the foregoing and other drawbacks found in the prior art and provides a dispensing device for tubular containers of the collapsible type which can be very inexpensively constructed and yet will be very durable in use. Also, the device of the present invention can be readily disassembled for cleaning as well as for replacement of an expended tubular container.

In one embodiment, the device of the present invention includes a retaining means in the form of a housing which is shaped to hold a tubular container in a predetermined orientation therein. The housing has a wall portion provided with a slot which extends along the length of the housing. Disposed on the interior of the housing is a press member in the form of a solid block of material such as plastic, wood or the like which is formed with a leading edge, a base portion and a smooth gradually sloping surface which extends between the leading edge and base portion. An elongated handle is attached to the topside of the press member above the base portion with the handle extending upwardly through the slot in the wall of the housing. The handle is located toward the rear portion of the press member remote from its leading edge so that pivoting of the handle by an individual will result in a rocking motion of the press member on the curved surface of the member.

The upper wall of the housing of the dispensing device of the present invention is provided with guide means for the press member in the form of shoulders located on opposite sides of the housing. The upper surface of the press member is flat to cooperate with the shoulders formed on the upper wall of the housing. The shoulders of the housing extend in and define a plane so that when an individual pulls on the handle of the press member, the press member will move along a line parallel to the plane defined by the shoulders of the housing. With a tubular container located in the housing, when the press member is moved along the housing to bring the curved surface of the press member into contact with the tube, dispensing of the material from the tube is initiated by simply pivoting the handle to squeeze the tube between the press member and the bottom wall of the housing.

The dispensing device of the present invention can be very economically manufactured in view of the fact that there is only one moving part which also renders it capable of very simple operation by even very young children. Moreover, disassembly of the housing and press member can be very quickly effected to permit cleaning of the elements and substitution of a new tubular container. Moreover, the device of the present invention can be constructed to accommodate a great variety of tube sizes in view of the fact that the press member can effectively operate on very small tubes just as well as on tubes of a size equivalent to the full capacity of the housing due to the unique rocking movement afforded by the sloping curved surface of the press member.

In another embodiment, the handle is rigidly secured to the press member and has a planar stem portion having a length approximately equal to the length of the top surface of the press member and which extends through the slot in the upper wall of the housing. Fixed to the protruding end of the stem is a manually engageable portion having a length approximately equal to the length of the press member and which is bent or curved approximately at its midpoint so that the section of the portion lying over the leading edge of the press member extends at an angle away from the plane of the top surface of the press member. Thus, a user of the device can effect pivoting of the press member by rocking the manually engageable portion of the handle about the bent or curved section to bring the forward section of the handle portion into flush engagement with the top wall of the housing. The trailing section of the manually engageable portion of the handle will extend in a plane that is parallel to the plane of the top surface of the press member and thus serve to space the bottom of the press member a predetermined distance from the bottom wall of the housing when this trailing section of the handle engages the top wall of the housing adjacent the slot. The spacing or gap between the bottom of the press member and the bottom wall of the housing will serve to facilitate movement of the press member along the longitudinal length of the housing by permitting the collapsed portion of the tube to interfit through the clearance thus provided. As a consequence, the possibility of the press member becoming jammed between the guide shoulders and the partially collapsed or totally collapsed tube is eliminated. In addition, accurate control of the dispensing is assured by virtue of the limited pivotability of the press member which is dependent on the angle of bend between the forward and trailing sections of the manually engageable portion of the handle.

The foregoing and other advantages will become apparent as consideration is given to the following detailed description of the invention and the accompanying drawings in which:

BRIEF DESCRIPTION OF THE DRAWINGS

FIG. 5 is a perspective view of another embodiment of the device of the present invention; and FIG. 6 is a side view in elevation, showing in broken lines, a variant of the press member and handle.

DETAILED DESCRIPTION OF THE INVENTION

Figure 1:
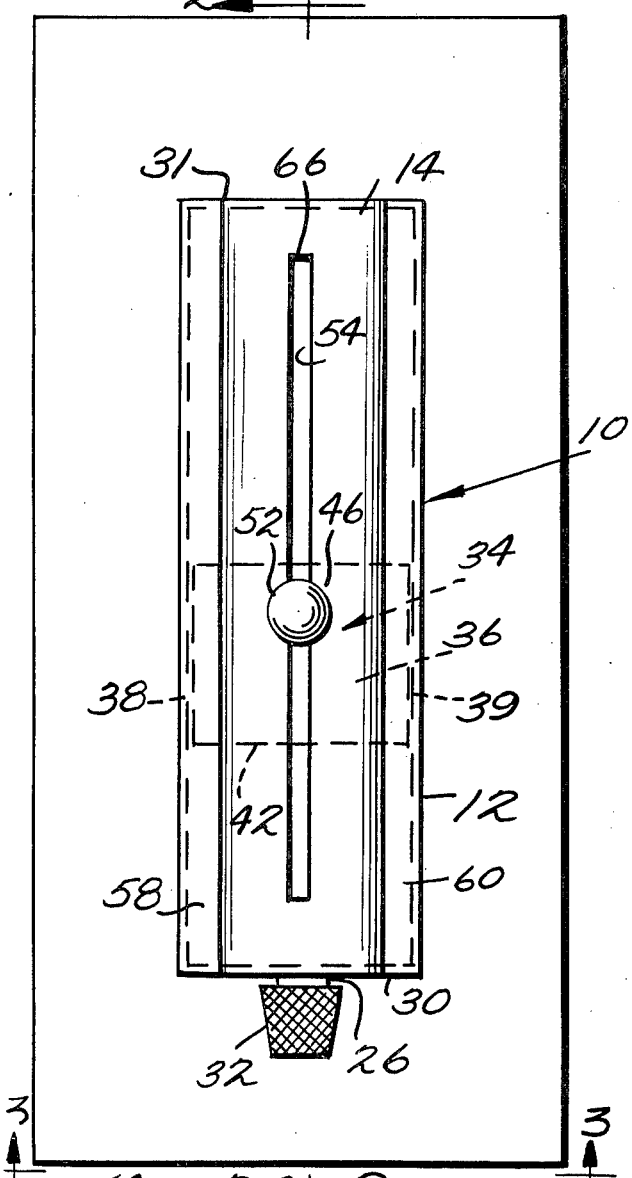
FIG. 1 is a plan view of the device of the present invention.

Referring now to the drawings, wherein like numerals designate corresponding parts throughout the several views, there is illustrated in FIG. 1 a plan view of the dispenser of the present invention generally designated at 10. The dispenser 10 includes a housing 12 which is formed with a top wall 14, and, as is more clearly shown in FIGS. 2–4, side walls 16 and 18 and a bottom wall 20. The bottom wall 20 may be eliminated where the remaining walls of the housing can be secured directly to a supporting surface such as the wall 22. As will be evident to those skilled in this art, the housing 12 can be secured to a support or wall 22 by any suitable means including the conventional screws, adhesives or brackets.

Figure 2:
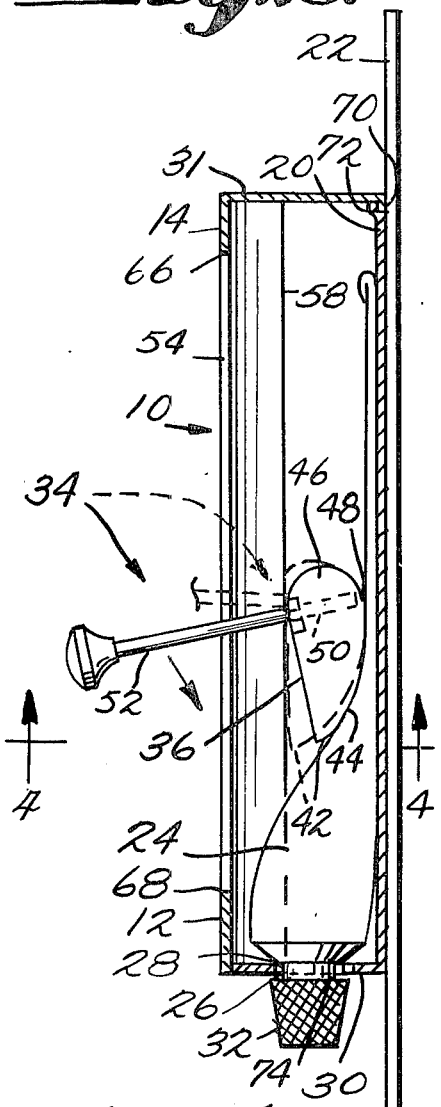
FIG. 2 is a view taken partially along lines 2—2 of FIG. 1 with only parts of the housing broken away.

The volume capacity of the housing 12 should be sufficiently large to accommodate as wide a range of collapsible tubular containers as is practical. As illustrated in FIG. 2, a partially collapsed tube 24 is disposed within the housing 12 with the neck 26 of the tube 24 exposed in an aperture 28 formed in end wall 30 of the housing. A cap 32 of conventional design is secured on the neck 26 of the tube 24 which, of course, will be removed when it is desired to dispense material from the tube. With the foregoing arrangement, where the dispensing device 10 is mounted to extend vertically, as illustrated, any size tube smaller than the largest size capable of fitting within the housing 12 can be employed with the present invention since it is not necessary to obtain precise vertical alignment of the axis of the tube 24 within the housing between the side walls 16 and 18. For efficient operation, it is only necessary that the neck 24 of the tube protrude through the opening or aperture 28, as will be made apparent from the following description of the press member generally designated at 34.

Figure 4:
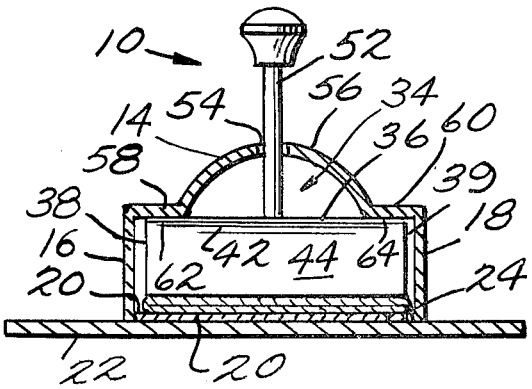
FIG. 4 is a view taken along lines 4—4 of FIG. 2.

Referring now to FIGS. 1, 2 and 4, the press member 34 of the present invention comprises a block of solid material such as wood or hard plastic, in a preferred embodiment, which is formed with a flat top surface 36 which, as shown in dotted lines in FIG. 1, has a width which extends substantially across the entire width of the housing 12. The sides 38 and 39 of the press member 34 are flat and extend at right angles from the top surface 36 (see FIG. 4). Extending between the sides 38 and 39 of the press member 36 is a blunted leading edge 42 which defines the front portion of the press member 34. By avoiding a sharp edge, the possibility of the press member cutting into a tubular container during use is avoided.

As shown more clearly in FIG. 2, the underside of the press member 34 is formed with a smooth, gradually sloping surface 44 which extends from the leading edge 42 to the rear portion 46 and the base portion 48 will be slightly rounded. The rear portion 46 is formed with a bore 50 for receiving one end of a handle 52. As illustrated, the handle is threaded into the bore 50, but it should be understood that a friction fit can also be usefully employed. It is desirable, however, that the handle 52 be removably secured to the press member 34 so that unauthorized use of the dispensing device 10 can be prevented by simply removing the handle 52.

The handle 52 should be of sufficient length so that it will extend upwardly through a slot 54 formed in the top wall 14 of the housing 12. Slot 54 is formed to extend from adjacent one end of the housing 12 to a point adjacent the other end 30.

Figure 3:
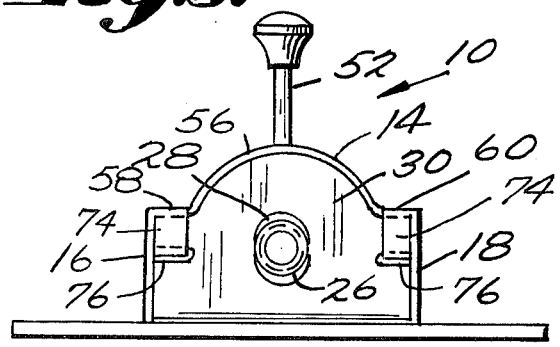
FIG. 3 is a view taken along lines 3—3 of FIG. 1.

As illustrated more clearly in FIGS. 3 and 4, the top wall 14 of the housing 12 is formed with a part cylindrical portion 56 and laterally extending shoulder portions 58 and 60. The shoulder portions 58 and 60 serve as guide means for the press member 36 by virtue of the juxtaposition of the outer edges 62 and 64 of the top surface 36 of the press member 34, respectively, to the shoulders 58 and 60 when the press member is disposed within the housing 12. Thus, since the shoulder portions 58 and 60 extend parallel to each other and define a plane, movement of the handle 52 by an individual will effect sliding movement of the press member 34 parallel to the plane defined by the shoulder portions 58 and 60 by virtue of the contact of the outer edges 62 and 64 with the shoulder portions 58 and 60, respectively.

From the foregoing description, it will be apparent that the operation of the dispensing device 10 of the present invention is extremely simple and, thus, capable of use by even very small children when the handle 52 is in place. With a tube 24 retained in the housing 12, as illustrated, and the cap 32 of the tube removed, an individual need simply pull the handle 52 towards the end wall 30 an appropriate distance to effect dispensing of the desired quantity of material from the tube 24. Since the handle 52 is disposed immediately above the base portion 48 and on the rear portion 46 of the press member 34, any pulling force exerted on the handle 52 in the direction of the end wall 30 of the housing 12 will automatically effect a rocking movement of the press member from the dotted line position illustrated in FIG. 2 toward the solid line position. As a result of the rocking movement, the portions of the outer edges 62 and 64 that are adjacent the rear portion 46 of the press member 34 will remain in contact with the guiding shoulder portions 58 and 60 while the leading edge 42 will move away from the plane defined by the shoulder portions 58 and 60.

With the foregoing arrangement, the quantity of material dispensed from the tube 24 can be easily varied from very small increments corresponding to a very slight tilting of the press member 34, to a large and rapidly effected discharge of material which is accomplished by simply continuously pulling the handle from the rear end 66 to the front end 68 of the slot 54. In circumstances where the contents of the tube are not entirely fluid such as is the case where certain types of chemical compositions have been packaged in collapsible tubes such as paints, dyes or other materials which have a tendency to coagulate, the press member 34 of the present invention can be employed to break up accumulations of hardened material to thus render the contents more fluid and thus easily dispensable. This is accomplished, for example, where resistance to dispensing is encountered, by simply repeatedly rocking the press member on the tube 24 to break up a hardened area of the contained composition.

Periodically, it may be desirable to clean the interior of the housing 12, and, to facilitate disassembly, the rear wall 31 is provided with a hooked portion 70 which cooperates with a recess 72 formed at the end of the bottom wall 20 with the bottom wall 20 and end wall 30 being formed integrally, and with the top wall 14, side walls 16 and 18 and rear wall 31 being formed integrally to provide a removable portion of the housing 12, the removable portion is pivotably attached to the end wall 30 by means of depending lugs 74, the ends of which are bent to fit into apertures 76 formed in the end wall 30. Thus, by making at least rear wall 31 from a partially flexible material, disassembly of the housing 12 can be effected by detaching the hook portion 70 from the recess 72 which will render the interior of the housing 12 accessible for cleaning.

The remaining portions of the housing 12 should be constructed from relatively rigid materials such as high molecular weight plastics or chrome metal so as to be resistant to corrosion due to exposure to moisture.

It will be apparent that the housing 12 need not be vertically mounted since the dispensing operation can just as easily be effected when the housing is horizontally disposed where adequate provision is made for collecting material dispensed from the tube. By virtue of the fact the press member 34 extends substantially across the entire width of the housing 12, the device of the present invention can be employed to dispense material from tubes having a volume far smaller than the capacity volume of the housing 12 since it is not critical that the longitudinal axis of the tube coincide or be parallel with the longitudinal axis of the housing in order for efficient dispensing to be carried out with the press member 34 of the present invention. Turning now to FIGS. 5 and 6, there is illustrated another embodiment of the present invention which differs from the foregoing embodiment principally in the construction of the handle portion of the press member of the present invention. In this embodiment generally designated at 78, the upper or top wall 80 of the housing 82 differs from the top wall of the previously described embodiment only in that the uppermost portion is flat as at 84. Parallel shoulder portions 86 and 88 are provided similar to the shoulder portions 58 and 60 of the first described embodiment. Also, a cap member 90, which has an aperture 92 formed therein, may be snap-fitted over the end of the housing 82. A slot 94 is formed in the flat portion 84 of the upper wall 80 for the same purpose as the slot 54 of the embodiment of FIGS. 1-4.

Turning now to the illustration of FIG. 6, there is shown a tube 96 in the housing 82 with the rear of the tube in engagement with a press member 98 which is similar to the press member 34, previously described, except that the pressing surface 100 is substantially planar and extends from the curved or rounded base 102 to the leading edge 104 of the press member 98. The upper surface portion 106 of the press member 98 is flat as in the previous embodiment and has a width sufficient to span the interior of the housing between the side walls so that the outer edges of the surface 106 will each lie adjacent the shoulders 86 and 88 so as to be guided thereby when the press member 98 is moved longitudinally of the housing.

To effect the movement of the press member 98, a flat elongated stem 108 is rigidly secured as by an adhesive or by pinning to the press member to extend substantially perpendicularly from the surface 106 at a point intermediate the outer edges of the surface 106. The transverse thickness of the stem 108 should be, of course, smaller than the width of the slot 94 to permit unobstructed sliding of the handle along the housing. The longitudinal dimension of stem 108, for the sake of rigidity, should be about three-quarters of the length dimension of surface 106.

The stem 108 projects through the slot 104 and has secured to its protruding end 110 a manually engageable portion generally designated at 112. Portion 112 has a forward or leading section 114 and a trailing section 116, both of which have flat undersides, 118 and 120, respectively. The underside surface 120 is fixed on the stem 108 a selected distance from the upper surface 106 of the press member 98 so that when the surface 120 rests on the upper flat portion 84 of the top wall 80, the base 102 of the press member 98 will be spaced a suitable distance from the bottom wall 122 of the housing 82 to provide a clearance between the base 102 of the press member and the bottom wall 122, as shown. This will permit the collapsed portion of the tube 96 to fit between the base 102 and the bottom wall 122 of the housing. This construction will also maintain the side edges of the upper surface 106 of the press member 98 in intimate contact with the guide shoulders 86 and 88.

As shown in FIG. 6, sections 114 and 116 extend at an angle to each other with the trailing section 116 extending in a plane parallel to the upper surface 106 of the press member 98 and the forward section 114 extending at an angle to this plane. A curved or bent segment 124 defines the boundary between the sections 114 and 116 and also defines a pivot point about which the handle 112 can be pivoted in the direction of arrow 126 in order to pivot the press member 98 against the collapsible tube 96 to effect dispensing of material from the tube 96 in small increments. As with the previous embodiment, dispensing of large quantities of material from the tube is a rapid manner is effected by simply sliding the handle and thereby the press member along the housing towards the aperture 92. With such dispensing, jamming of the tube in the housing between the press member and bottom wall of the housing is prevented by the provision of the aforementioned clearance.

The press member and its associated handle and stem may be made of high impact plastic molded to the shape illustrated, although other materials may also be utilized.

With the foregoing arrangement of the handle and press member, accurate dispensing of even small quantities of material from the tube can be effected merely by pressing on the forward section 114 of the portion 112 of the handle since the pivot point 124 is located between the base 102 and leading edge 104 of the press member 98.

From a consideration of the foregoing, it will be seen that the objects of this invention may be readily accomplished by implementation of the apparatus disclosed herein. It will be realized, however, that various changes may be made in the specific embodiment shown without departing from the spirit and scope of the invention as defined in the appended claims.

What is claimed is:

1. Apparatus for dispensing material contained in a collapsible tube comprising:

a plurality of walls including a top and a bottom wall and first and second end walls connected together to define a housing enclosure for the tube, said first end wall having an aperture for receiving the neck of the tube, said top wall extending between said end walls, said top wall having a raised central portion and opposite sides, said central portion extending the length of said housing, a slot formed in said central portion of said top wall extending between said end walls, a planar shoulder portion extending from each side of said central portion with said shoulder portions extending the length of said housing substantially perpendicular to said side walls, a press member slidably disposed in said housing, said press member having a flat top surface having outer parallel side edges each being immediately adjacent and engageable with said shoulder portion so as to be slidable thereon, said press member including a leading edge and a rear portion both extending between said outer parallel side edges, a base located adjacent said rear portion, and perpendicularly spaced from said top surface, a pressing surface extending from said leading edge to said base, said top surface of said press member having a handle stem extending substantially perpendicularly therefrom through said slot in said top wall of said housing, said handle stem having a manually engageable portion fixed thereto exteriorly of said housing, said manually engageable portion having a leading section and a trailing section with said trailing section extending parallel to said top surface of said press member and with said leading section extending at an angle relative to said trailing section.

2. The apparatus as claimed in claim 1 wherein said trailing section of said manually engageable portion is fixed on said handle stem at a predetermined distance from said top surface of said press member so that, when said trailing section engages said top wall of said housing, and base of said press member will be spaced a predetermined distance from said bottom wall of said housing.

3. The apparatus as claimed in claim 1 wherein said stem extends longitudinally along said slot a distance at least half the longitudinal length of said press member and said manually engageable portion has a longitudinal dimension approximately equal to the longitudinal length of said press member.

4. The apparatus as claimed in claim 3 wherein said leading and trailing sections of said manually engageable portion intersect at a curved section lying approximately at the midpoint of said manually engageable portion.

* * * * *